US010543580B2

(12) United States Patent
Watanabe

(10) Patent No.: US 10,543,580 B2
(45) Date of Patent: Jan. 28, 2020

(54) GRINDING APPARATUS AND GRINDING METHOD

(71) Applicant: JTEKT CORPORATION, Osaka-shi (JP)

(72) Inventor: Akira Watanabe, Chiryu (JP)

(73) Assignee: JTEKT CORPORATION, Osaka-shi (JP)

( * ) Notice: Subject to any disclaimer, the term of this patent is extended or adjusted under 35 U.S.C. 154(b) by 221 days.

(21) Appl. No.: 15/860,132

(22) Filed: Jan. 2, 2018

(65) Prior Publication Data

US 2018/0193976 A1 Jul. 12, 2018

(30) Foreign Application Priority Data

Jan. 10, 2017 (JP) ..... 2017-002055

(51) Int. Cl.

| | |
|---|---|
| ***B24B 49/00*** | (2012.01) |
| ***B24B 41/00*** | (2006.01) |
| ***B24B 41/04*** | (2006.01) |
| *B24B 7/06* | (2006.01) |

(52) U.S. Cl.

CPC ..... *B24B 41/007* (2013.01); *B24B 41/042* (2013.01); *B24B 7/06* (2013.01)

(58) Field of Classification Search

CPC ..... B24B 49/00; B24B 41/007; B24B 41/042
USPC ..... 451/5, 8, 9, 10, 49
See application file for complete search history.

(56) References Cited

U.S. PATENT DOCUMENTS 3,218,884 A * 11/1965 Backer ..... B24B 41/042 74/571.1
3,866,489 A * 2/1975 Kimmelaar ..... B24B 41/042 74/570.2
5,569,060 A * 10/1996 Mori ..... B21B 28/04 451/425
2018/0345451 A1* 12/2018 Conde Decimavilla ..... B24B 49/00

FOREIGN PATENT DOCUMENTS

JP 2011-143503 7/2011

* cited by examiner

*Primary Examiner* — Robert A Rose
(74) *Attorney, Agent, or Firm* — Oblon, McClelland, Maier & Neustadt, L.L.P.

(57) ABSTRACT

A grinding apparatus includes grinding wheel side vibrational displacement calculation devices that obtain a vibrational displacement of a grinding wheel resulting from a vibration in an approaching/separating direction of the grinding wheel; main spindle side vibrational displacement calculation devices that obtain a vibrational displacement of a workpiece generated by propagation of the vibration in the approaching/separating direction of the grinding wheel; a relative vibrational displacement calculation unit that obtains a relative vibrational displacement between the grinding wheel and the workpiece based on the vibrational displacement of the grinding wheel and the vibrational displacement of the workpiece that have been obtained; a position change unit that creates, based on the obtained relative vibrational displacement between the grinding wheel and the workpiece, a position change command to change a position of the wheel spindle stock; and a processing controller that grinds the workpiece W based on the created position change command.

9 Claims, 8 Drawing Sheets

GRINDING APPARATUS AND GRINDING METHOD

INCORPORATION BY REFERENCE

The disclosure of Japanese Patent Application No. 2017-002055 filed on Jan. 10, 2017 including the specification, drawings and abstract, is incorporated herein by reference in its entirety.

BACKGROUND OF THE INVENTION

1. Field of the Invention

The present invention relates to a grinding apparatus and a grinding method.

2. Description of Related Art

In a grinding apparatus, since a grinding wheel essentially has an unbalanced mass distribution with respect to the rotational center thereof, a vibration occurs due to the imbalance while the grinding wheel rotates, and chatter is generated on a surface of a workpiece while being ground. As a method for adjusting the balance of the grinding wheel, a method is used in which the adjustment is made by manually attaching a balance piece to the grinding wheel while measuring a relative vibration using a vibrometer. This method has, however, a disadvantage that labor and time are required for the balance adjustment. Although a method is also used in which the balance is automatically adjusted by providing an automatic balancer as an attachment, this method has a disadvantage of increase in equipment cost.

In some cases, in the grinding apparatus, the balance of the grinding wheel is lost or changed because of a change in diameter of the grinding wheel caused by dressing, or of chips attached to the grinding wheel, and the imbalance of the grinding wheel generates the chatter on the surface of the workpiece while being ground. Thus, for example, Japanese Patent Application Publication No. 2011-143503 (JP 2011-143503 A) describes a grinding apparatus in which a workpiece pressing device is disposed in a position shifted in phase by 180 degrees from a grinding point of the workpiece. This grinding apparatus reduces the chatter by pressing the workpiece with the workpiece pressing device, and vibrationally displacing the workpiece in a phase opposite to the phase of a relative vibrational displacement between the workpiece and the grinding wheel.

In the grinding apparatus described in JP 2011-143503 A mentioned above, such workpiece pressing devices need to be disposed in positions shifted in phase by 180 degrees from all grinding points of the workpiece. In reality, however, the workpiece pressing devices are difficult to be disposed in such positions, and thus, the chatter of the workpiece cannot be sufficiently reduced in some cases.

SUMMARY OF THE INVENTION

It is an object of the present invention to provide a grinding apparatus and a grinding method that are capable of sufficiently reducing the chatter of the workpiece.

A grinding apparatus according to an aspect of the present invention is a grinding apparatus that includes a headstock and a wheel spindle stock that are supported on a bed, and that grinds a workpiece by rotating the workpiece held by a main spindle of the headstock and a grinding wheel held by a wheel spindle of the wheel spindle stock, and by relatively moving the grinding wheel toward and away from the workpiece.

The grinding apparatus includes:

a grinding wheel side vibrational displacement calculation device that obtains a vibrational displacement of the grinding wheel resulting from a vibration in an approaching and separating direction of the grinding wheel caused by an imbalance of the grinding wheel about a rotational axis line of the grinding wheel;

a main spindle side vibrational displacement calculation device that obtains a vibrational displacement of the workpiece generated by propagation of the vibration in the approaching and separating direction of the grinding wheel from the wheel spindle stock through the bed;

a relative vibrational displacement calculation unit that obtains a relative vibrational displacement between the grinding wheel and the workpiece based on the vibrational displacement of the grinding wheel and the vibrational displacement of the workpiece that have been obtained;

a position change unit that creates, based on the obtained relative vibrational displacement between the grinding wheel and the workpiece, a position change command to change a position of the wheel spindle stock; and a processing controller that grinds the workpiece based on the created position change command.

According to this aspect of the present invention, the grinding wheel side vibrational displacement calculation device obtains the vibrational displacement of the grinding wheel based on the vibrational displacement of the wheel spindle stock, and the main spindle side vibrational displacement calculation device obtains the vibrational displacement of the workpiece based on the vibrational displacement of the headstock. Thus, the relative vibrational displacement between the grinding wheel and the workpiece can be simply obtained. Consequently, substantially constant contact can be achieved between the grinding wheel and the workpiece by moving the grinding wheel so as to cancel out the relative vibrational displacement between the grinding wheel and the workpiece. As a result, without the need for disposing the workpiece pressing devices in positions shifted in phase by 180 degrees from all grinding points of the workpiece in the conventional way, the chatter of the workpiece can be sufficiently reduced, and the accuracy of grinding of the workpiece can be improved.

A grinding method according to another aspect of the present invention is a method for grinding a workpiece by using an apparatus including a headstock and a wheel spindle stock that are supported on a bed, and by rotating the workpiece held by a main spindle of the headstock and a grinding wheel held by a wheel spindle of the wheel spindle stock, and relatively moving the grinding wheel toward and away from the workpiece.

The grinding method includes:

a grinding wheel side vibrational displacement calculation step of obtaining a vibrational displacement of the grinding wheel resulting from a vibration in an approaching and separating direction of the grinding wheel caused by an imbalance thereof about a rotational axis line thereof;

a main spindle side vibrational displacement calculation step of obtaining a vibrational displacement of the workpiece generated by propagation of the vibration in the approaching and separating direction of the grinding wheel from the wheel spindle stock through the bed;

a relative vibrational displacement calculation step of obtaining a relative vibrational displacement between the grinding wheel and the workpiece based on the vibrational displacement of the grinding wheel and the vibrational displacement of the workpiece that have been obtained;

a position change step of creating, based on the obtained relative vibrational displacement between the grinding wheel and the workpiece, a position change command to change a position of the wheel spindle stock; and a processing control step of grinding the workpiece based on the created position change command.

According to the grinding method of this aspect, the same effects as the effects of the grinding apparatus described above can be obtained.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENT

Figure 1:
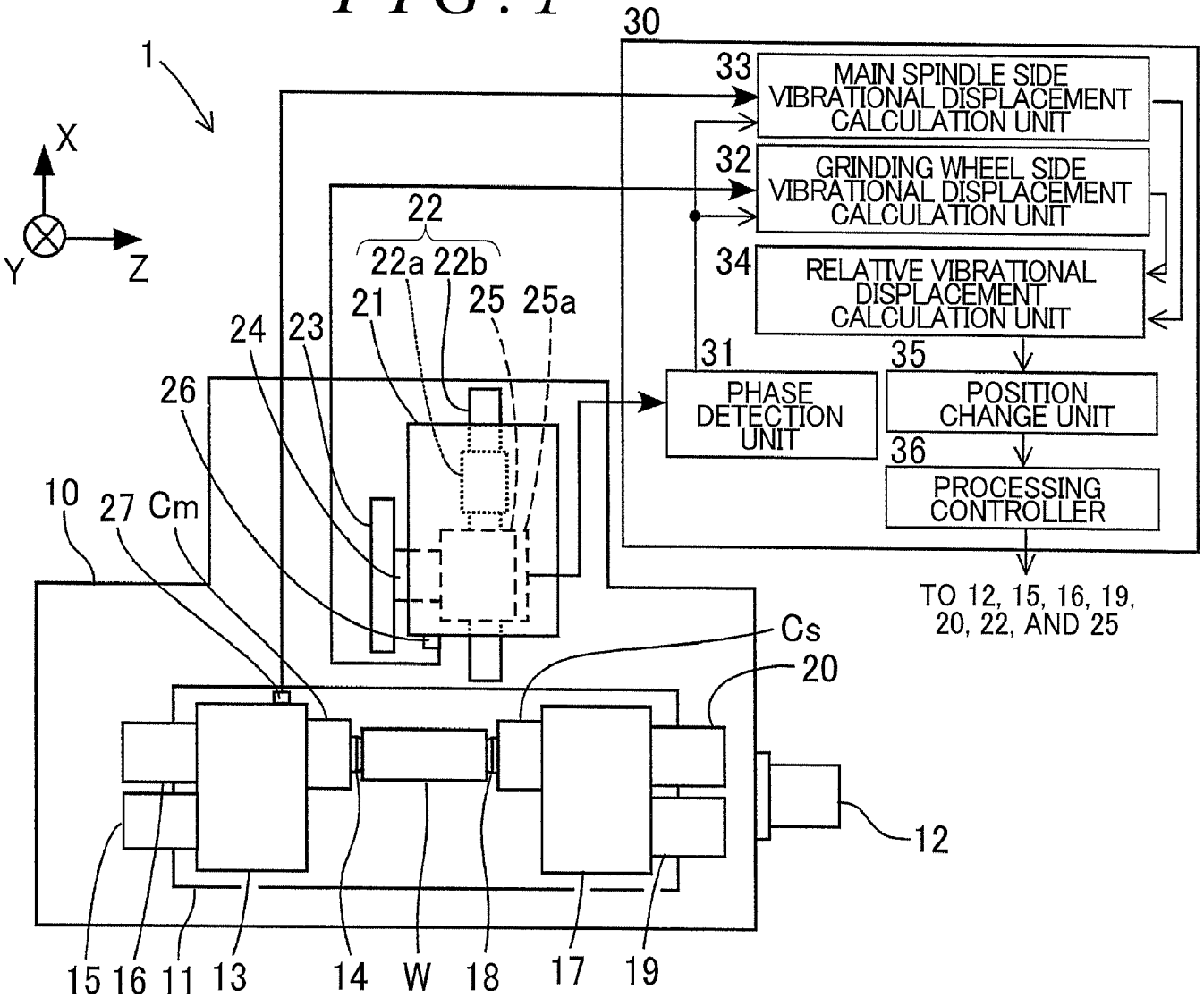
FIG. 1 is a plan view of a grinding apparatus according to an embodiment of the present invention as viewed from the Y-axis direction.

The following describes a table traverse cylindrical grinding apparatus as an example of a grinding apparatus of an embodiment of the present invention. As illustrated in FIG. 1, a grinding apparatus 1 includes, for example, a bed 10, a table 11, a headstock 13, a tailstock 17, a wheel spindle stock 21, and a control device 30. The table 11 is guidingly supported on the bed 10 so as to be movable in the Z-axis direction (right-left direction in FIG. 1) by a Z-axis servo motor 12. The headstock 13 for rotatably pivotally supporting a master spindle Cm is placed on the table 11. A center 14 for supporting an end of a workpiece W is mounted at a distal end of the master spindle Cm. The master spindle Cm is advanced and retreated by a predetermined amount in the axis line direction thereof by an advance/retreat drive device 15, and is rotationally driven by a master servo motor 16.

In addition, the tailstock 17 is placed on the table 11 at a location facing the headstock 13. A slave spindle Cs is rotatably pivotally supported on the tailstock 17 so as to be coaxial with the master spindle Cm. A center 18 for supporting the other end of the workpiece W is mounted at a distal end of the slave spindle Cs. The slave spindle Cs is reciprocated in the axis line direction thereof by a servo motor 19 for controlling a center pressing force, and is rotationally driven by a slave servo motor 20 in synchronization with the master spindle Cm.

The wheel spindle stock 21 is guidingly supported in a rear side position of the table 11 on the bed 10 so as to be movable in the X-axis direction (upper-lower direction in FIG. 1) orthogonal to the Z-axis direction by a linear motor 22. The linear motor 22 includes an electromagnetic coil unit 22*a* mounted on the wheel spindle stock 21 and a permanent magnetic plate unit 22*b* placed on the bed 10, and is operationally controlled based on position feedback from a linear scale (not illustrated).

A grinding wheel 23 is pivotally supported on the wheel spindle stock 21 via a wheel spindle 24 that is rotatable about an axis line parallel to the Z-axis direction, and the grinding wheel 23 is rotationally driven by a built-in wheel spindle drive motor 25. The wheel spindle drive motor 25 includes a rotary encoder 25*a* (phase detection device). The wheel spindle stock 21 is provided with a grinding wheel side accelerometer 26 (grinding wheel side vibrational displacement calculation device) that measures a vibrational displacement in a feed direction (approaching/separating direction, i.e., X-axis direction) of the wheel spindle stock 21 generated by a vibration of the rotating grinding wheel 23 in a feed direction (approaching/separating direction, i.e., X-axis direction) thereof. The headstock 13 is provided with a main spindle side accelerometer 27 (main spindle side vibrational displacement calculation device) that measures a vibrational displacement (vibrational displacement in the feed direction of the grinding wheel 23, i.e., in the X-axis direction) of the headstock 13 generated by propagation of the above-described vibration of the rotating grinding wheel 23 in the feed direction thereof through the bed 10 and the table 11.

Figure 2:
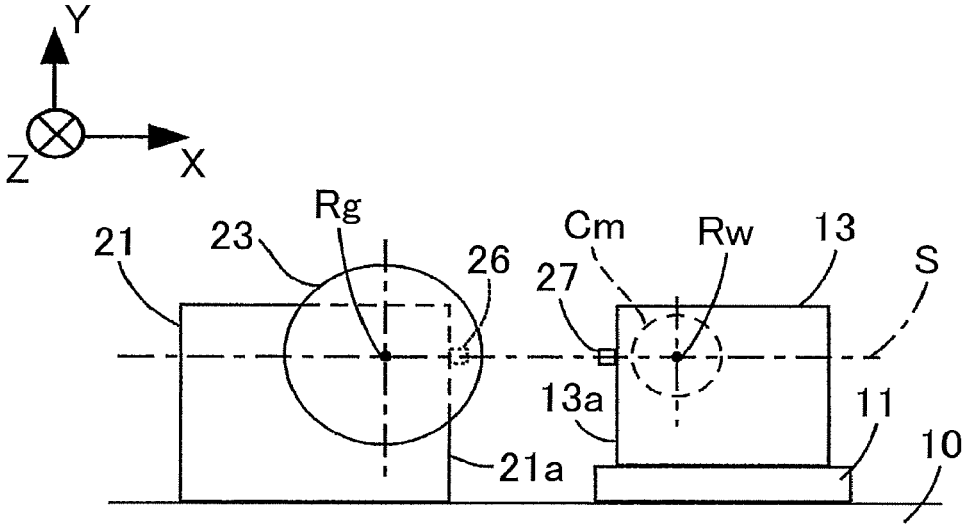
FIG. 2 is a view of an arrangement of a grinding wheel side accelerometer and a main spindle side accelerometer in the grinding apparatus as viewed from the Z-axis direction.

For example, capacitive accelerometers or resistive accelerometers are used as the grinding wheel side accelerometer 26 and the main spindle side accelerometer 27. As illustrated in FIG. 2, the grinding wheel side accelerometer 26 and the main spindle side accelerometer 27 are disposed in a plane S including a rotational axis line Rw of the workpiece W and a rotational axis line Rg of the grinding wheel 23. The grinding wheel side accelerometer 26 is disposed, for example, on a side surface 21*a* on the workpiece W side of the wheel spindle stock 21 so as to align an acceleration detection direction with a feed direction X of the wheel spindle stock 21. The main spindle side accelerometer 27 is disposed, for example, on a side surface 13*a* on the grinding wheel 23 side of the headstock 13 so as to align an acceleration detection direction with the feed direction X of the wheel spindle stock 21. If the mounting height differs between the grinding wheel side accelerometer 26 and the main spindle side accelerometer 27, the amount of the measured vibrational displacement differs therebetween. However, since these accelerometers are mounted at the same height, the vibrational displacement in the feed direction X of the wheel spindle stock 21 and the vibrational displacement in the X-axis direction of the headstock 13 can be accurately measured.

The control device 30 includes a phase detection unit 31 (phase detection device), a grinding wheel side vibrational displacement calculation unit 32 (grinding wheel side vibrational displacement calculation device), a main spindle side vibrational displacement calculation unit 33 (main spindle side vibrational displacement calculation device), a relative vibrational displacement calculation unit 34, a position change unit 35, and a processing controller 36.

The phase detection unit 31 detects a rotational phase (angle) of the grinding wheel 23 based on a phase detection signal from the rotary encoder 25*a* provided in the wheel spindle drive motor 25.

Figure 4:
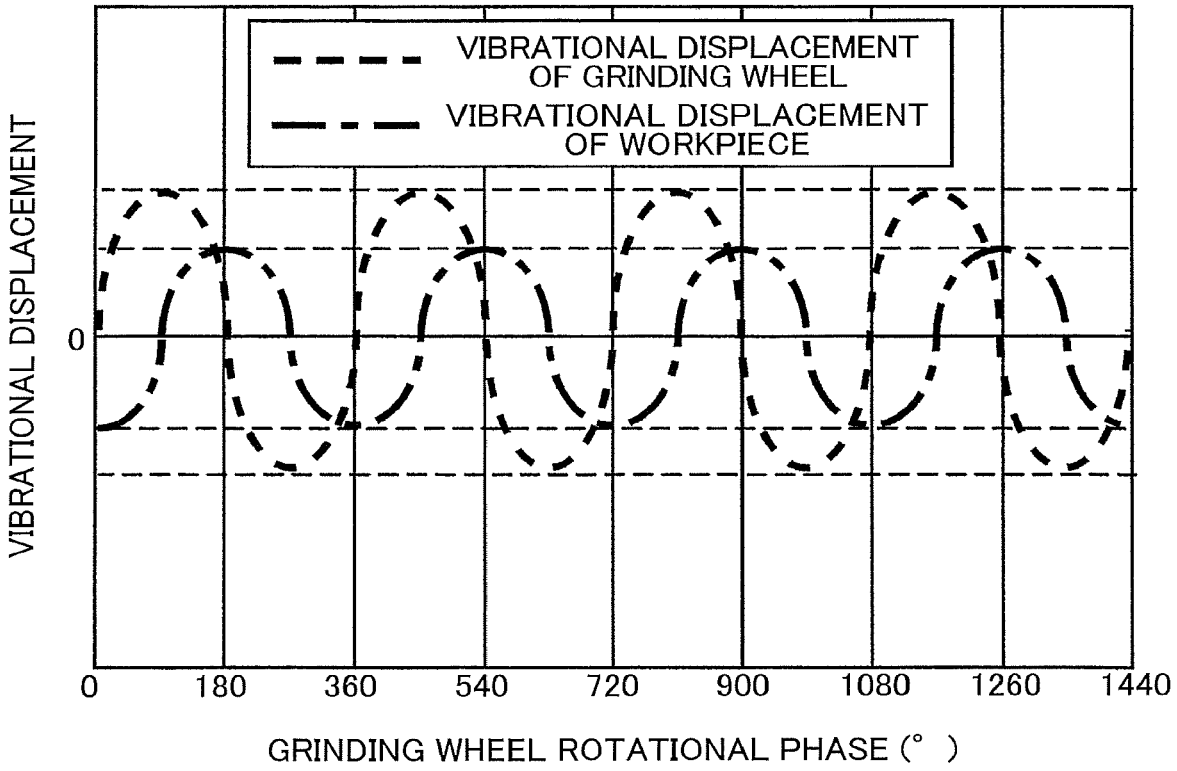
FIG. 4 is a diagram illustrating relations of a vibrational displacement of a grinding wheel and a vibrational displacement of a workpiece with a rotational phase of the grinding wheel.

The grinding wheel side vibrational displacement calculation unit 32 integrates an acceleration signal from the grinding wheel side accelerometer 26 twice to obtain the vibrational displacement in the feed direction X of the wheel spindle stock 21 generated by the vibration in the feed direction X of the rotating grinding wheel 23. The grinding wheel side vibrational displacement calculation unit 32 stores a table representing a relation between the measured vibrational displacement in the feed direction X of the wheel spindle stock 21 and the vibrational displacement in the feed direction X of the grinding wheel 23. As indicated by a dashed line in FIG. 4, the grinding wheel side vibrational displacement calculation unit 32 obtains the vibrational displacement in the feed direction X of the grinding wheel 23 from the obtained vibrational displacement in the feed direction X of the wheel spindle stock 21 with reference to the table, and associates the vibrational displacement in the feed direction X of the grinding wheel 23 with the rotational phase (angle) of the grinding wheel 23 received from the phase detection unit 31.

The main spindle side vibrational displacement calculation unit 33 integrates an acceleration signal from the main spindle side accelerometer 27 twice to obtain the vibrational displacement in the X-axis direction of the headstock 13 generated by the propagation of the vibration in the feed direction X of the rotating grinding wheel 23 through the bed 10 and the table 11. The main spindle side vibrational displacement calculation unit 33 stores a table representing a relation between the measured vibrational displacement in the X-axis direction of the headstock 13 and the vibrational displacement in the X-axis direction of the workpiece W. As indicated by a long dashed short dashed line in FIG. 4, the main spindle side vibrational displacement calculation unit 33 obtains the vibrational displacement in the X-axis direction of the workpiece W from the obtained vibrational displacement in the X-axis direction of the headstock 13 with reference to the table, and associates the vibrational displacement in the X-axis direction of the workpiece W with the rotational phase (angle) of the grinding wheel 23 received from the phase detection unit 31.

Figure 5:
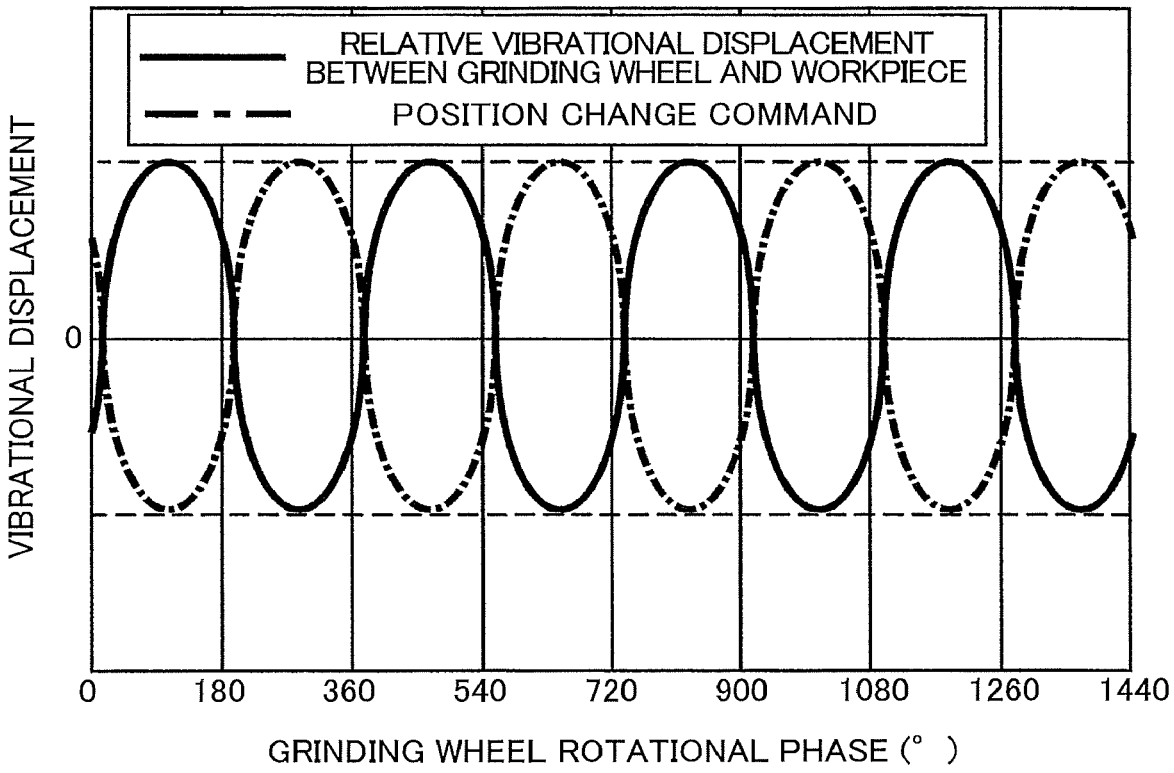
FIG. 5 is a diagram illustrating relations of a relative vibrational displacement between the grinding wheel and the workpiece and a vibrational displacement serving as the position change command for a wheel spindle stock with the rotational phase of the grinding wheel.

The relative vibrational displacement calculation unit 34 obtains a relative vibrational displacement between the grinding wheel 23 and the workpiece W with respect to the rotational phase (angle) of the grinding wheel 23, as indicated by a solid line in FIG. 5, by adding the vibrational displacement in the feed direction X of the grinding wheel 23 with respect to the rotational phase (angle) of the grinding wheel 23 obtained by the grinding wheel side vibrational displacement calculation unit 32 to the vibrational displacement in the X-axis direction of the workpiece W with respect to the rotational phase (angle) of the grinding wheel 23 obtained by the main spindle side vibrational displacement calculation unit 33.

The position change unit 35 creates table data representing a position change command for the wheel spindle stock 21 for restraining the relative vibrational displacement between the grinding wheel 23 and the workpiece W with respect to the rotational phase (angle) of the grinding wheel 23 received from the relative vibrational displacement calculation unit 34. As indicated by a long dashed short dashed line in FIG. 5, this position change command is a command in a phase opposite to that of the relative vibrational displacement between the grinding wheel 23 and the workpiece W with respect to the rotational phase (angle) of the grinding wheel 23. Since the frequency (such as 320 Hz) at which the linear motor 22 is displaceable is sufficiently higher than the frequency (such as 60 Hz) of the vibrational displacement of the grinding wheel 23, the wheel spindle stock 21 can be accurately changed in position.

The processing controller 36 grinds the workpiece W by controlling operations of the Z-axis servo motor 12, the advance/retreat drive device 15, the master servo motor 16, the servo motor 19, the slave servo motor 20, the linear motor 22, and the wheel spindle drive motor 25. At this time, the processing controller 36 detects the rotational phase (angle) of the grinding wheel 23, selects the position change command for the wheel spindle stock 21 with reference to the data table, received from the position change unit 35, representing the position change command for the wheel spindle stock 21 with respect to the rotational phase (angle) of the grinding wheel 23, and adds the selected position change command to a position command (absolute position) for the wheel spindle stock 21 in a numerical control (NC) program. If the wheel spindle stock 21 is controlled by a movement amount command (relative position), the processing controller 36 adds a selected movement amount change command for the wheel spindle stock 21 to the movement amount command (relative position) for the wheel spindle stock 21 in the NC program.

The inventor of the present invention has found the following matter. That is, in the grinding apparatus 1, an imbalance in mass distribution of the grinding wheel 23 generates the vibration in the feed direction of the rotating grinding wheel 23, and this vibration of the grinding wheel 23 is transmitted through the bed 10 and the table 11 to generate the vibration of the workpiece W in the feed direction of the rotating grinding wheel 23. The relative vibration between the vibration of the grinding wheel 23 and the vibration of the workpiece W generates chatter on a surface of the workpiece W.

The workpiece W rotates at a low speed, such as 50 revolutions per minute, whereas the grinding wheel 23 rotates at a speed, such as 3500 revolutions per minute, much higher than that of the rotation of the workpiece W. Consequently, this chatter is hardly affected by the rotation of the workpiece W, and is more affected by the rotation of the grinding wheel 23. The grinding apparatus 1 of the present embodiment adds the position change command in the phase opposite to that of the relative vibrational displacement between the grinding wheel 23 and the workpiece W generated by the vibration of the wheel spindle stock 21 and the headstock 13 to an operation command for the linear motor 22. This operation can cancel out the relative vibrational displacement between the grinding wheel 23 and the workpiece W, and can thus reduce the chatter of the workpiece W.

When the grinding wheel 23 before being subjected to a rough grinding step (first grinding step) has come closest to the workpiece W (during an idle grinding operation) after the grinding wheel 23 has been replaced or trued, the grinding apparatus 1 of the present embodiment obtains the relative vibrational displacement between the grinding wheel 23 and the workpiece W with respect to the rotational phase (angle) of the grinding wheel 23, and creates and stores the data table. The grinding apparatus 1 adds the position change command for the wheel spindle stock 21 in the phase opposite to that of the relative vibrational displacement between the grinding wheel 23 and the workpiece W to the position command (absolute position) for the wheel spindle stock 21 in the rough grinding step of the NC program. By adding the position change command for the wheel spindle stock 21 to the position command (absolute position) for the wheel spindle stock 21 in the rough grinding step of the NC program, the grinding apparatus 1 automatically calls the position change command for the wheel spindle stock 21 corresponding to the rotational phase (angle) of the grinding wheel 23 from the data table, and adds the position change command for the wheel spindle stock 21 to the position command (absolute position) for the wheel spindle stock 21 during the rough grinding in the NC program. Consequently, the relative vibrational displacement between the grinding wheel 23 and the workpiece W can be canceled out, and the chatter of the workpiece W can be reduced to improve the processing accuracy of the workpiece W.

During the rough grinding step before a precision grinding step (second grinding step) after the grinding wheel 23 has been replaced or trued, the grinding apparatus 1 obtains the relative vibrational displacement between the grinding wheel 23 and the workpiece W with respect to the rotational phase (angle) of the grinding wheel 23, and creates and stores the data table. The grinding apparatus 1 adds the position change command for the wheel spindle stock 21 in the phase opposite to that of the relative vibrational displacement between the grinding wheel 23 and the workpiece W to the position command (absolute position) for the wheel spindle stock 21 in the rough grinding step of the NC program. By adding the position change command for the wheel spindle stock 21 to the position command (absolute position) for the wheel spindle stock 21 in the rough grinding step of the NC program, the grinding apparatus 1 automatically detects the rotational phase (angle) of the grinding wheel 23, calls the position change command for the wheel spindle stock 21 corresponding to the rotational phase (angle) of the grinding wheel 23 from the data table, and adds the position change command for the wheel spindle stock 21 to the position command (absolute position) for the wheel spindle stock 21 during the precision grinding in the NC program, without issuing the position change command during the rough grinding step. Consequently, the relative vibrational displacement between the grinding wheel 23 and the workpiece W can be canceled out to remove the chatter generated by the rough grinding, using the precision grinding. The following describes operations of respective processes.

Figure 3A:
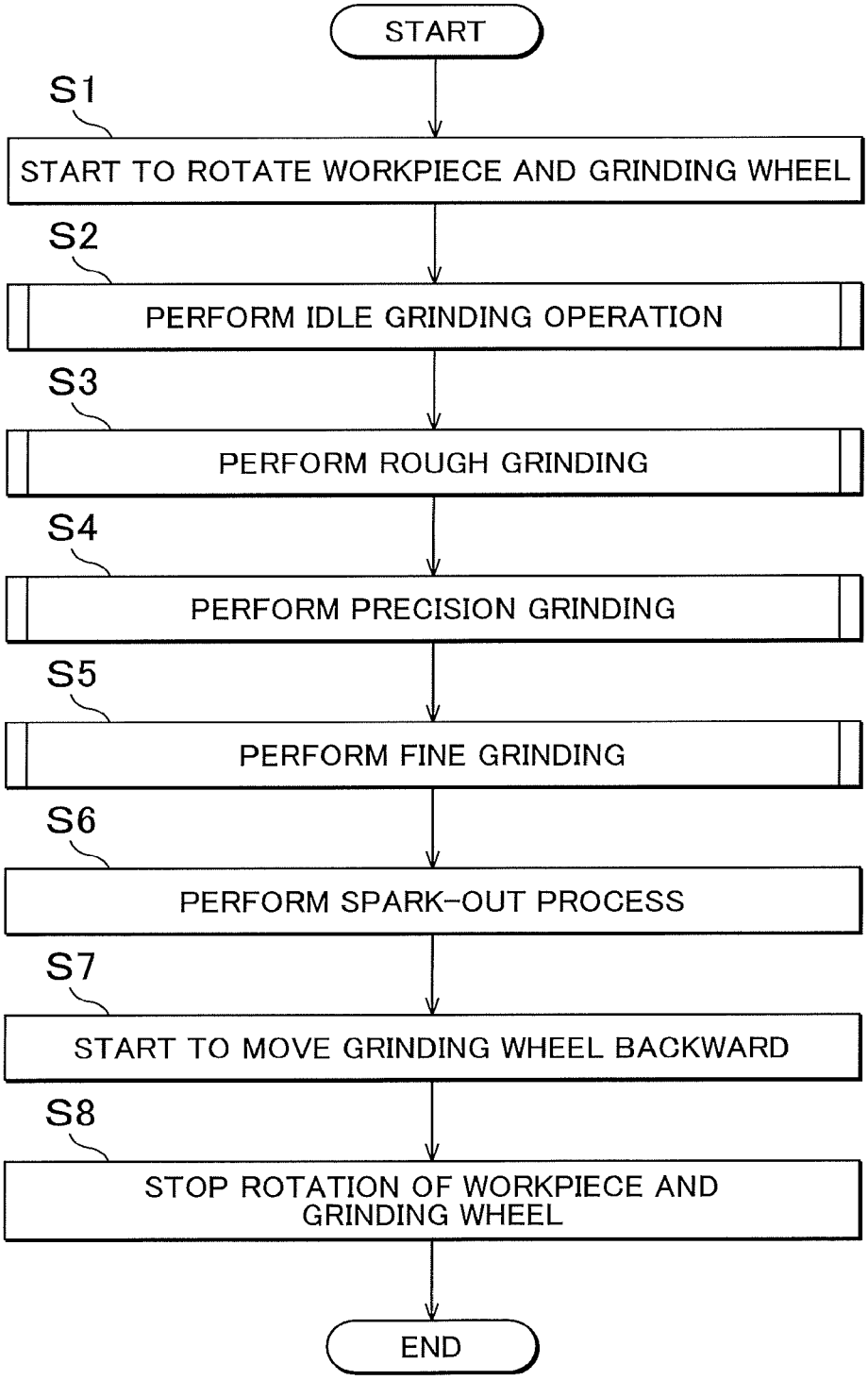
FIG. 3A is a flowchart for explaining an operation of the grinding apparatus.

The description will first be given of an operation of the grinding apparatus 1 in the present embodiment when the relative vibrational displacement between the grinding wheel 23 and the workpiece W is obtained during the idle grinding operation, with reference to the drawings. The control device 30 starts to rotate the workpiece W and the grinding wheel 23 (Step S1 in FIG. 3A), and moves the grinding wheel 23 forward in the X-axis direction toward the workpiece W to start the idle grinding operation (Step S2 in FIG. 3A).

Specifically, the processing controller 36 controls the operations of the master servo motor 16, the slave servo motor 20, and the wheel spindle drive motor 25 to start to rotate the workpiece W and the grinding wheel 23, and controls the operation of the linear motor 22 to start to move the grinding wheel 23 forward in the X-axis direction toward the workpiece W.

Figure 3B:
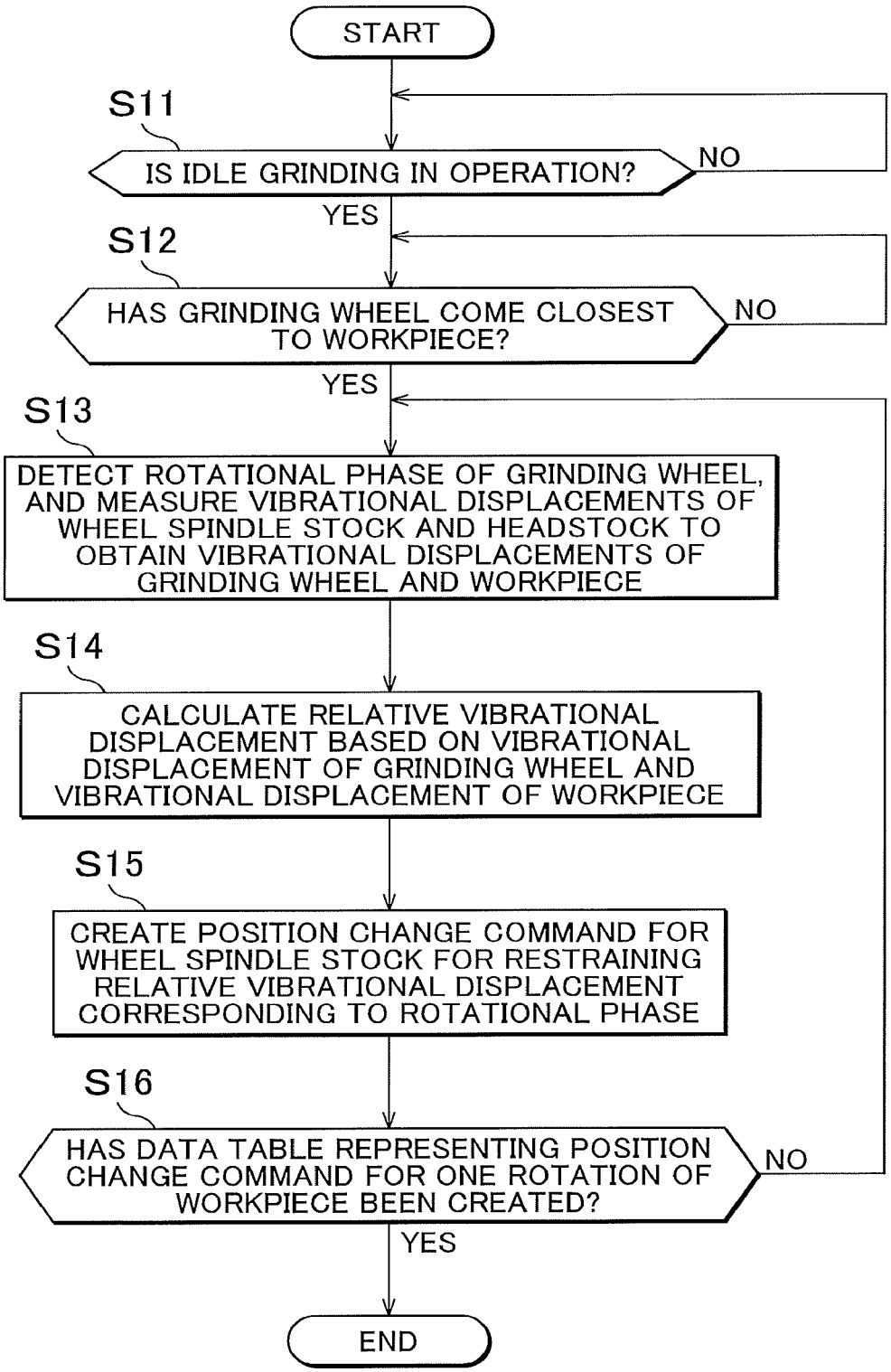
FIG. 3B is a flowchart for explaining a flowchart for explaining a process to generate a position change command.

The control device 30 determines whether the idle grinding is in operation (Step S11 in FIG. 3B), and if so, the control device 30 detects the position of the wheel spindle stock 21, and determines whether the grinding wheel 23 has come closest to the workpiece W during the idle grinding (Step S12 in FIG. 3B). If so, the control device 30 detects the rotational phase (angle) of the grinding wheel 23, and measures the vibrational displacement of the wheel spindle stock 21 and the vibrational displacement of the headstock 13 to obtain the vibrational displacement of the grinding wheel 23 and the vibrational displacement of the workpiece W (Step S13 in FIG. 3B, i.e., a grinding wheel side vibrational displacement calculation step and a main spindle side vibrational displacement calculation step).

Specifically, during the idle grinding, the phase detection unit 31 detects the rotational phase (angle) of the grinding wheel 23 based on the phase detection signal received from the rotary encoder 25*a* of the wheel spindle drive motor 25. The grinding wheel side vibrational displacement calculation unit 32 obtains the vibrational displacement in the feed direction X of the wheel spindle stock 21 based on the acceleration signal from the grinding wheel side accelerometer 26, and obtains the vibrational displacement in the feed direction X of the grinding wheel 23 with respect to the rotational phase (angle) of the grinding wheel 23. The main spindle side vibrational displacement calculation unit 33 obtains the vibrational displacement in the X-axis direction of the headstock 13 based on the acceleration signal from the main spindle side accelerometer 27, and obtains the vibrational displacement in the X-axis direction of the workpiece W with respect to the rotational phase (angle) of the grinding wheel 23.

Based on the vibrational displacement in the feed direction X of the grinding wheel 23 with respect to the rotational phase (angle) of the grinding wheel 23 and the vibrational displacement in the X-axis direction of the workpiece W with respect to the rotational phase (angle) of the grinding wheel 23 that have been obtained, the control device 30 obtains the relative vibrational displacement between the grinding wheel 23 and the workpiece W with respect to the rotational phase (angle) of the grinding wheel 23 (Step S14 in FIG. 3B, i.e., a relative vibrational displacement calculation step). The control device 30 creates the position change command for the wheel spindle stock 21 for restraining the obtained relative vibrational displacement between the grinding wheel 23 and the workpiece W with respect to the rotational phase (angle) of the grinding wheel 23 (Step S15 in FIG. 3B, i.e., a position change step).

Specifically, the relative vibrational displacement calculation unit 34 obtains the relative vibrational displacement between the grinding wheel 23 and the workpiece W with respect to the rotational phase (angle) of the grinding wheel 23 by adding the vibrational displacement in the feed direction X of the grinding wheel 23 with respect to the rotational phase (angle) of the grinding wheel 23 obtained by the grinding wheel side vibrational displacement calculation unit 32 to the vibrational displacement in the X-axis direction of the workpiece W with respect to the rotational phase (angle) of the grinding wheel 23 obtained by the main spindle side vibrational displacement calculation unit 33. To restrain the relative vibrational displacement between the grinding wheel 23 and the workpiece W with respect to the rotational phase (angle) of the grinding wheel 23 received from the relative vibrational displacement calculation unit 34, the position change unit 35 creates the position change command for the wheel spindle stock 21 in the phase opposite to that of the relative vibrational displacement between the grinding wheel 23 and the workpiece W with respect to the rotational phase (angle) of the grinding wheel 23.

The control device 30 determines whether the data table representing the position change command for one rotation (over a rotational phase (angle) of 0 degrees to 360 degrees) of the workpiece W has been created (Step S16 in FIG. 3B, i.e., the position change step), and, if not, returns the process to Step S13 to repeat the above-described processing, or if so, ends the processing. The control device 30 uses the created data table representing the position change command for the wheel spindle stock 21 in the rough grinding step, the precision grinding step, and a fine grinding step to sequentially perform the respective grinding steps (Steps S3 to S5 in FIG. 3A, i.e., processing control steps).

Figure 3C:
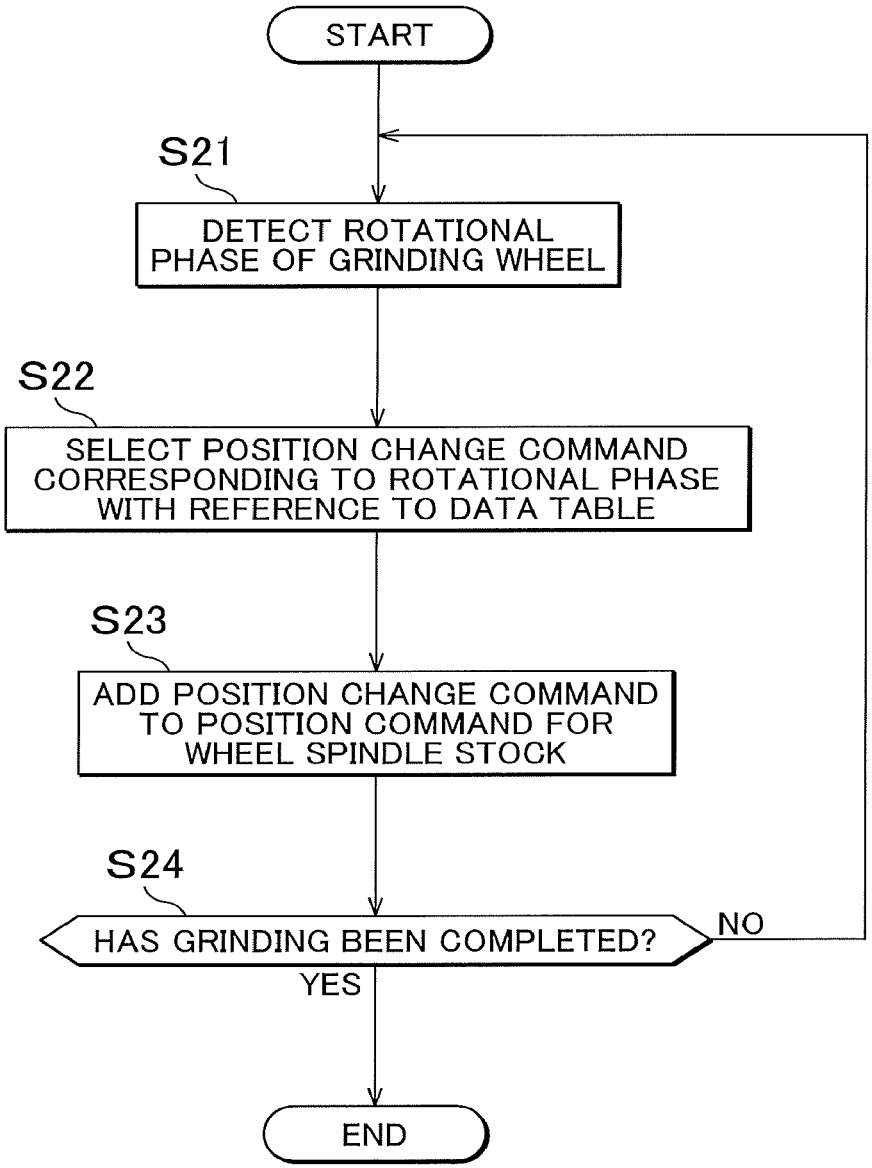
FIG. 3C is a flowchart for explaining a flowchart for explaining a process to use the position change command.

Specifically, the processing controller 36 detects the rotational phase (angle) of the grinding wheel 23 (Step S21 in FIG. 3C), selects the position change command for the wheel spindle stock 21 with reference to the data table, received from the position change unit 35, representing the position change command for the wheel spindle stock 21 with respect to the rotational phase (angle) of the grinding wheel 23 (Step S22 in FIG. 3C), adds the selected position change command to the position command (absolute position) for the wheel spindle stock 21 in the numerical control NC program and controls the operation of the linear motor 22 (Step S23 in FIG. 3C), and grinds the workpiece W by controlling the operations of the master servo motor 16, the slave servo motor 20, and the wheel spindle drive motor 25. The processing controller 36 determines whether the grinding process has been completed (Step S24 in FIG. 3C), and, if not, returns the process to Step S21 to repeat the above-described processing, or if so, ends the processing.

After all the grinding steps have been completed, the control device 30 performs a spark-out process (Step S6 in FIG. 3A), starts to move the grinding wheel 23 backward in the X-axis direction from the workpiece W (Step S7 in FIG. 3A), stops the rotation of the workpiece W and the grinding wheel 23 (Step S8 in FIG. 3A), and ends the whole processing.

Specifically, after the grinding of the workpiece W has been completed, the processing controller 36 controls the operation of the linear motor 22 to start to move the grinding wheel 23 backward in the X-axis direction from the workpiece W, and controls the operations of the master servo motor 16, the slave servo motor 20, and the wheel spindle drive motor 25 to stop the rotation of the workpiece W and the grinding wheel 23.

The following describes an operation of the grinding apparatus 1 in the present embodiment when the relative vibrational displacement is obtained during the rough grinding, with reference to the drawings. The specific operation thereof is equivalent to the operation described with reference to FIGS. 3A to 3C, and thus will not be described. The control device 30 starts to rotate the workpiece W and the grinding wheel 23 (Step S1 in FIG. 3A), and moves the grinding wheel 23 forward in the X-axis direction toward the workpiece W to start the idle grinding operation (Step S2 in FIG. 3A). After performing the idle grinding operation, the control device 30 starts the rough grinding step (Step S3 in FIG. 3A).

Figure 3D:
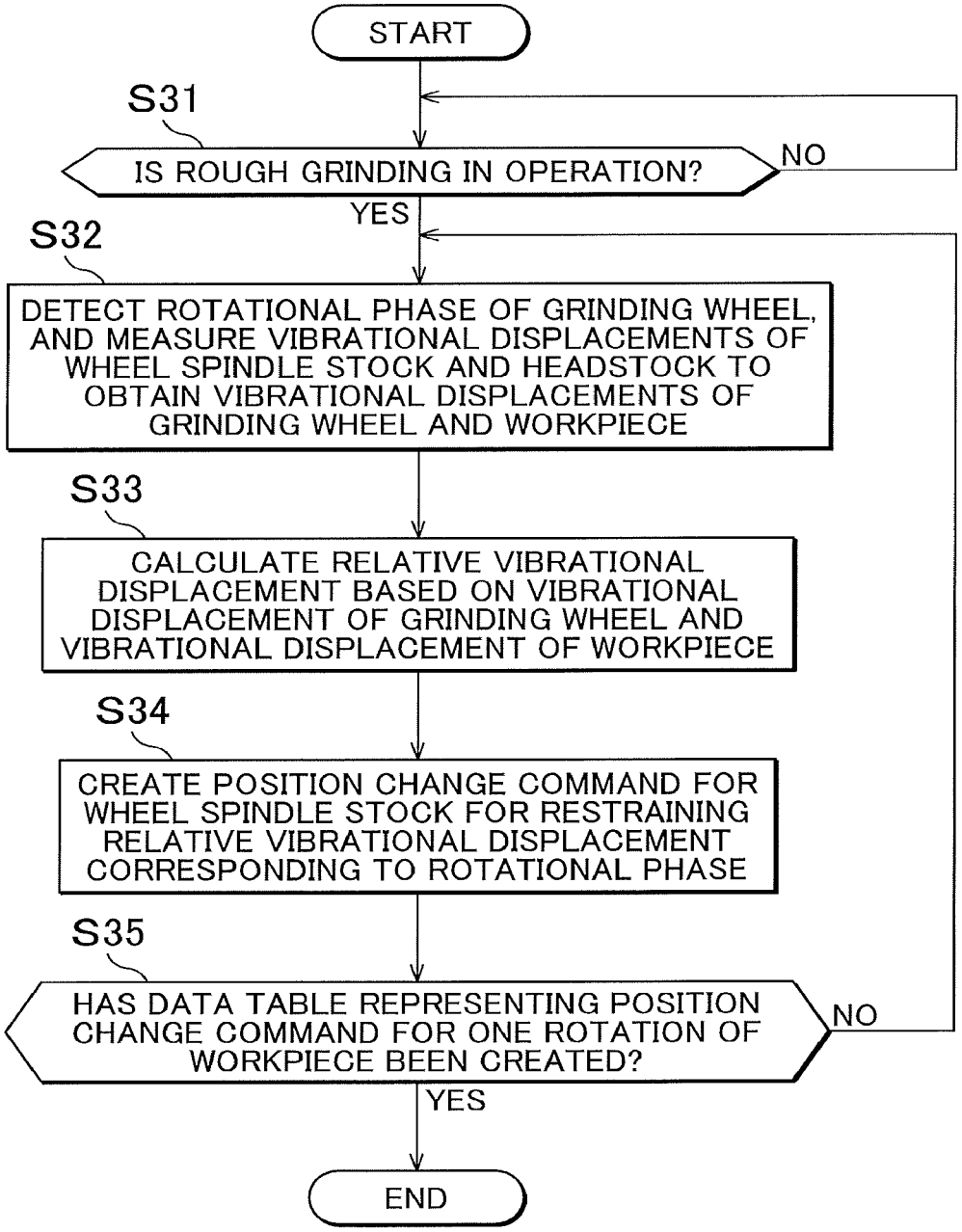
FIG. 3D is a flowchart for explaining another example of the process to generate the position change command.

The control device 30 determines whether the rough grinding is in operation (Step S31 in FIG. 3D), and, if so, the control device 30 detects the rotational phase (angle) of the grinding wheel 23, and measures the vibrational displacement of the wheel spindle stock 21 and the vibrational displacement of the headstock 13 to obtain the vibrational displacement of the grinding wheel 23 and the vibrational displacement of the workpiece W (Step S32 in FIG. 3D, i.e., the grinding wheel side vibrational displacement calculation step and the main spindle side vibrational displacement calculation step). Based on the vibrational displacement in the feed direction X of the grinding wheel 23 with respect to the rotational phase (angle) of the grinding wheel 23 and the vibrational displacement in the X-axis direction of the workpiece W with respect to the rotational phase (angle) of the grinding wheel 23 that have been obtained, the control device 30 obtains the relative vibrational displacement between the grinding wheel 23 and the workpiece W with respect to the rotational phase (angle) of the grinding wheel 23 (Step S33 in FIG. 3D, i.e., the relative vibrational displacement calculation step). The control device 30 creates the position change command for the wheel spindle stock 21 for restraining the obtained relative vibrational displacement between the grinding wheel 23 and the workpiece W with respect to the rotational phase (angle) of the grinding wheel 23 (Step S34 in FIG. 3D, i.e., the position change step).

The control device 30 determines whether the data table representing the position change command for one rotation (over a rotational phase (angle) of 0 degrees to 360 degrees) of the workpiece W has been created (Step S35 in FIG. 3D, i.e., the position change step), and, if not, returns the process to Step S32 to repeat the above-described processing, or if so, ends the processing. After completing the rough grinding step, the control device 30 uses the created table data representing the position change command for the wheel spindle stock 21 in the precision grinding step and the fine grinding step to sequentially perform the respective grinding steps (Steps S4 and S5 in FIG. 3A, i.e., the position change steps). At the time of shifting from the rough grinding step to the precision grinding step and at the time of shifting the precision grinding step to the fine grinding step, the detected rotational phase (angle) of the grinding wheel 23 is synchronized, and the table data representing the position change command for the wheel spindle stock 21 is used.

After all the grinding steps have been completed, the control device 30 performs the spark-out process (Step S6 in FIG. 3A), starts to move the grinding wheel 23 backward in the X-axis direction from the workpiece W (Step S7 in FIG. 3A), stops the rotation of the workpiece W and the grinding wheel 23 (Step S8 in FIG. 3A), and ends the whole processing.

In the embodiment described above, since the wheel spindle drive motor 25 is a built-in motor, the rotational phase (angle) of the grinding wheel 23 can be accurately detected based on the phase detection signal from the rotary encoder 25*a*.

In the present embodiment, the grinding apparatus 1 is configured to operate in such a manner as to detect the rotational phase (angle) of the grinding wheel 23, to select the position change command for the wheel spindle stock 21 with reference to the data table representing the position change command for the wheel spindle stock 21 with respect to the rotational phase (angle) of the grinding wheel 23, and to add the selected position change command to the position command (absolute position) for the wheel spindle stock 21 in the numerical control NC program. However, the grinding apparatus 1 can cancel out the relative vibrational displacement between the wheel spindle stock 21 and the headstock 13 by feeding back the obtained relative vibrational displacement between the wheel spindle stock 21 and the headstock 13 in real time, and by issuing the position change command for the wheel spindle stock 21, without detecting the rotational phase (angle) of the grinding wheel 23.

In the embodiment described above, the wheel spindle stock 21 is configured to be changed in position by the linear motor 22. However, for example, a piezoelectric vibrator or the like may be placed between the wheel spindle stock 21 and a transfer rail of the wheel spindle stock 21, and be provided so as to displace the wheel spindle stock 21 in the feed direction thereof, thereby configuring the wheel spindle stock 21 to be changed in position.

The grinding apparatus 1 of the present embodiment includes the headstock 13 and the wheel spindle stock 21 that are supported on the bed 10, and grinds the workpiece W by rotating the workpiece W held by the main spindles Cm and Cs of the headstock 13 and the grinding wheel 23 held by the wheel spindle 24 of the wheel spindle stock 21, and by relatively moving the grinding wheel 23 toward and away from the workpiece W. The grinding apparatus 1 includes the grinding wheel side vibrational displacement calculation device 26 and 32 that obtains the vibrational displacement of the grinding wheel 23 resulting from the vibration in the approaching/separating direction of the grinding wheel 23 caused by the imbalance thereof about the rotational axis line thereof; the main spindle side vibrational displacement calculation device 27 and 33 that obtains the vibrational displacement of the workpiece W generated by the propagation of the vibration in the approaching/separating direction of the grinding wheel 23 from the wheel spindle stock 21 through the bed 10; the relative vibrational displacement calculation unit 34 that obtains the relative vibrational displacement between the grinding wheel 23 and the workpiece W based on the vibrational displacement of the grinding wheel 23 and the vibrational displacement of the workpiece W that have been obtained; the position change unit 35 that creates, based on the obtained relative vibrational displacement between the grinding wheel 23 and the workpiece W, the position change command to change the position of the wheel spindle stock 21; and the processing controller 36 that grinds the workpiece W based on the created position change command.

With this configuration, the grinding wheel side vibrational displacement calculation device 26 and 32 obtains the vibrational displacement of the grinding wheel 23 based on the vibrational displacement of the wheel spindle stock 21, and the main spindle side vibrational displacement calculation device 27 and 33 obtains the vibrational displacement of the workpiece W based on the vibrational displacement of the headstock 13. Thus, the relative vibrational displacement between the grinding wheel 23 and the workpiece W can be simply obtained. Consequently, substantially constant contact can be achieved between the grinding wheel 23 and the workpiece W by moving the grinding wheel 23 so as to cancel out the relative vibrational displacement between the grinding wheel 23 and the workpiece W. As a result, without the need for disposing the workpiece pressing devices in positions shifted in phase by 180 degrees from all grinding points of the workpiece W in the conventional way, the chatter of the workpiece W can be sufficiently reduced, and the accuracy of grinding of the workpiece W can be improved.

Since the grinding wheel side vibrational displacement calculation device 26 and 32 measures the vibrational displacement in the approaching/separating direction of the wheel spindle stock 21, and obtains the vibrational displacement of the grinding wheel 23 based on the measured vibrational displacement in the approaching/separating direction of the wheel spindle stock 21, the accuracy of the vibrational displacement of the grinding wheel 23 can be improved.

Since the main spindle side vibrational displacement calculation device 27 and 33 measures the vibrational displacement in the approaching/separating direction of the headstock 13, and obtains the vibrational displacement of the workpiece W based on the measured vibrational displacement in the approaching/separating direction of the headstock 13, the accuracy of the vibrational displacement of the workpiece W can be improved.

The grinding apparatus 1 includes the phase detection device 25*a* and 31 that detects the rotational phase of the grinding wheel 23. The relative vibrational displacement calculation unit 34 obtains and stores the relative vibrational displacement between the grinding wheel 23 and the workpiece W with respect to the detected rotational phase of the grinding wheel 23 during the idle grinding step before the grinding steps are performed. Based on the stored relative vibrational displacement between the grinding wheel 23 and the workpiece W with respect to the rotational phase of the grinding wheel 23, the position change unit 35 creates the position change command to change the position of the wheel spindle stock 21 during the first grinding step performed subsequent to the idle grinding step. The processing controller 36 selects the position change command for the wheel spindle stock 21 corresponding to the detected rotational phase of the grinding wheel 23, and adds the selected position change command to the position command for the wheel spindle stock 21 during the first grinding step and later steps that are performed subsequent to the idle grinding step. By adding the position change command for the wheel spindle stock 21 to the position command (absolute position) for the wheel spindle stock 21 in the first grinding step in the NC program during the idle grinding, the relative vibrational displacement between the grinding wheel 23 and the workpiece W can be canceled out during the first grinding, and the chatter of the workpiece W can be reduced to improve the processing accuracy of the workpiece W.

The grinding apparatus 1 includes the phase detection device 25*a* and 31 that detects the rotational phase of the grinding wheel 23. The relative vibrational displacement calculation unit 34 obtains and stores the relative vibrational displacement between the grinding wheel 23 and the workpiece W with respect to the detected rotational phase of the grinding wheel 23 during the first grinding step. Based on the stored relative vibrational displacement between the grinding wheel 23 and the workpiece W with respect to the rotational phase of the grinding wheel 23, the position change unit 35 creates the position change command to change the position of the wheel spindle stock 21 during the first grinding step. The processing controller 36 selects the position change command for the wheel spindle stock 21 corresponding to the detected rotational phase of the grinding wheel 23, and adds the selected position change command to the position command for the wheel spindle stock 21 during the second grinding step performed subsequent to the first grinding step. By calculating the relative vibrational displacement between the grinding wheel 23 and the workpiece W during the first grinding, the grinding apparatus 1 can cancel out the relative vibrational displacement between the grinding wheel 23 and the workpiece W during the second grinding to remove the chatter generated by the rough grinding, using the precision grinding, without issuing the position change command during the first grinding.

The grinding wheel side vibrational displacement calculation device 26 and 32 includes the grinding wheel side accelerometer 26, and measures the vibrational displacement of the wheel spindle stock 21 based on the acceleration signal from the grinding wheel side accelerometer 26. The main spindle side vibrational displacement calculation device 27 and 33 includes the main spindle side accelerometer 27, and measures the vibrational displacement of the headstock 13 based on the acceleration signal from the main spindle side accelerometer 27. With this configuration, each of the respective vibrational displacement calculation devices only needs to include corresponding one of the grinding wheel side accelerometer 26 and the main spindle side accelerometer 27, and a reduction in equipment cost can be achieved.

The grinding wheel side accelerometer 26 and the main spindle side accelerometer 27 are disposed in the plane S including the rotational axis line Rw of the workpiece W and the rotational axis line Rg of the grinding wheel 23. If the mounting height differs between the grinding wheel side accelerometer 26 and the main spindle side accelerometer 27, the amount of the measured vibrational displacement differs therebetween. However, since these accelerometers are mounted at the same height, the vibrational displacement in the feed direction X of the wheel spindle stock 21 and the vibrational displacement in the X-axis direction of the headstock 13 can be accurately measured.

The grinding apparatus 1 includes the linear motor 22 that moves the wheel spindle stock 21 toward and away from the workpiece W, and the position change unit 35 changes the position of the wheel spindle stock 21 using the linear motor 22. The frequency at which the linear motor 22 is displaceable is sufficiently higher than the frequency of the vibrational displacement of the grinding wheel 23, and thus, the linear motor 22 can sufficiently follow the vibrational displacement of the grinding wheel 23. Consequently, the wheel spindle stock 21 can be accurately changed in position.

According to the present embodiment, a grinding method for grinding the workpiece W by using an apparatus including the headstock 13 and the wheel spindle stock 21 that are supported on the bed 10, and by rotating the workpiece W held by the main spindles Cm and Cs of the headstock 13 and the grinding wheel 23 held by the wheel spindle 24 of the wheel spindle stock 21, and relatively moving the grinding wheel 23 toward and away from the workpiece W includes the grinding wheel side vibrational displacement calculation step of obtaining the vibrational displacement of the grinding wheel 23 resulting from the vibration in the approaching/separating direction of the grinding wheel 23 caused by the imbalance thereof about the rotational axis line thereof; the main spindle side vibrational displacement calculation step of obtaining the vibrational displacement of the workpiece W generated by the propagation of the vibration in the approaching/separating direction of the grinding wheel 23 from the wheel spindle stock 21 through the bed 10; the relative vibrational displacement calculation step of obtaining the relative vibrational displacement between the grinding wheel 23 and the workpiece W based on the vibrational displacement of the grinding wheel 23 and the vibrational displacement of the workpiece W that have been obtained; the position change step of creating, based on the obtained relative vibrational displacement between the grinding wheel 23 and the workpiece W, the position change command to change the position of the wheel spindle stock 21; and the processing control step of grinding the workpiece W based on the created position change command. According to the grinding method of the present invention, the same effects as the effects of the grinding apparatus described above can be obtained.

What is claimed is:

1. A grinding apparatus including a headstock and a wheel spindle stock that are supported on a bed, and being configured to grind a workpiece by rotating the workpiece held by a main spindle of the headstock and a grinding wheel held by a wheel spindle of the wheel spindle stock, and by relatively moving the grinding wheel toward and away from the workpiece, the grinding apparatus comprising:

a grinding wheel side vibrational displacement calculation device configured to obtain a vibrational displacement of the grinding wheel resulting from a vibration in an approaching and separating direction of the grinding wheel caused by an imbalance of the grinding wheel about a rotational axis line of the grinding wheel;

a main spindle side vibrational displacement calculation device configured to obtain a vibrational displacement of the workpiece generated by propagation of the vibration in the approaching and separating direction of the grinding wheel from the wheel spindle stock through the bed;

a relative vibrational displacement calculation unit configured to obtain a relative vibrational displacement between the grinding wheel and the workpiece based on the vibrational displacement of the grinding wheel and the vibrational displacement of the workpiece that have been obtained;

a position change unit configured to create, based on the obtained relative vibrational displacement between the grinding wheel and the workpiece, a position change command to change a position of the wheel spindle stock; and a processing controller configured to grind the workpiece based on the created position change command.

2. The grinding apparatus according to claim 1, wherein the grinding wheel side vibrational displacement calculation device is configured to measure a vibrational displacement in the approaching and separating direction of the wheel spindle stock, and to obtain the vibrational displacement of the grinding wheel based on the measured vibrational displacement in the approaching and separating direction of the wheel spindle stock.

3. The grinding apparatus according to claim 1, wherein the main spindle side vibrational displacement calculation device is configured to measure a vibrational displacement in the approaching and separating direction of the headstock, and to obtain the vibrational displacement of the workpiece based on the measured vibrational displacement in the approaching and separating direction of the headstock.

4. The grinding apparatus according to claim 1, further comprising a phase detection device configured to detect a rotational phase of the grinding wheel, wherein the relative vibrational displacement calculation unit is configured to obtain and store the relative vibrational displacement between the grinding wheel and the workpiece with respect to the detected rotational phase of the grinding wheel during an idle grinding step before grinding steps are performed, the position change unit is configured to create, based on the stored relative vibrational displacement between the grinding wheel and the workpiece with respect to the rotational phase of the grinding wheel, the position change command to change the position of the wheel spindle stock during a first grinding step performed subsequent to the idle grinding step, and the processing controller is configured to select the position change command for the wheel spindle stock corresponding to the detected rotational phase of the grinding wheel, and to add the selected position change command to a position command for the wheel spindle stock during a second grinding step and later steps that are performed subsequent to the first grinding step.

5. The grinding apparatus according to claim 1, further comprising a phase detection device configured to detect a rotational phase of the grinding wheel, wherein the relative vibrational displacement calculation unit is configured to obtain and store the relative vibrational displacement between the grinding wheel and the workpiece with respect to the detected rotational phase of the grinding wheel during a first grinding step, the position change unit is configured to create, based on the stored relative vibrational displacement between the grinding wheel and the workpiece with respect to the rotational phase of the grinding wheel, the position change command to change the position of the wheel spindle stock during the first grinding step, and the processing controller is configured to select the position change command for the wheel spindle stock corresponding to the detected rotational phase of the grinding wheel, and to add the selected position change command to a position command for the wheel spindle stock during a second grinding step and later steps that are performed subsequent to the first grinding step.

6. The grinding apparatus according to claim 1, wherein the grinding wheel side vibrational displacement calculation device comprises a grinding wheel side accelerometer, and is configured to measure a vibrational displacement of the wheel spindle stock based on an acceleration signal from the grinding wheel side accelerometer, and the main spindle side vibrational displacement calculation device comprises a main spindle side accelerometer, and is configured to measure a vibrational displacement of the headstock based on an acceleration signal from the main spindle side accelerometer.

7. The grinding apparatus according to claim 6, wherein the grinding wheel side accelerometer and the main spindle side accelerometer are disposed in a plane including a rotational axis line of the workpiece and the rotational axis line of the grinding wheel.

8. The grinding apparatus according to claim 1, further comprising a linear motor configured to move the wheel spindle stock toward and away from the workpiece, wherein the position change unit is configured to change the position of the wheel spindle stock using the linear motor.

9. A method for grinding a workpiece by using an apparatus including a headstock and a wheel spindle stock that are supported on a bed, and by rotating the workpiece held by a main spindle of the headstock and a grinding wheel held by a wheel spindle of the wheel spindle stock, and relatively moving the grinding wheel toward and away from the workpiece, the method comprising:

a grinding wheel side vibrational displacement calculation step of obtaining a vibrational displacement of the grinding wheel resulting from a vibration in an approaching and separating direction of the grinding wheel caused by an imbalance of the grinding wheel about a rotational axis line of the grinding wheel;

a main spindle side vibrational displacement calculation step of obtaining a vibrational displacement of the workpiece generated by propagation of the vibration in the approaching and separating direction of the grinding wheel from the wheel spindle stock through the bed;

a relative vibrational displacement calculation step of obtaining a relative vibrational displacement between the grinding wheel and the workpiece based on the vibrational displacement of the grinding wheel and the vibrational displacement of the workpiece that have been obtained;

a position change step of creating, based on the obtained relative vibrational displacement between the grinding wheel and the workpiece, a position change command to change a position of the wheel spindle stock; and a processing control step of grinding the workpiece based on the created position change command.

* * * * *